US011837833B2

(12) United States Patent
Kerstetter et al.

(10) Patent No.: US 11,837,833 B2
(45) Date of Patent: Dec. 5, 2023

(54) TERMINAL HOLDING DEVICE FOR CRIMP HAND TOOL

(71) Applicant: TE Connectivity Services GmbH, Schaffhausen (CH)

(72) Inventors: Chadwick Alan Kerstetter, Richfield, PA (US); Caleb Andrew Moyer, Harrisburg, PA (US); Robert Keeney, Millersburg, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 196 days.

(21) Appl. No.: 17/126,163

(22) Filed: Dec. 18, 2020

(65) Prior Publication Data

US 2022/0200222 A1 Jun. 23, 2022

(51) Int. Cl.
*H01R 43/042* (2006.01)

(52) U.S. Cl.
CPC ..... *H01R 43/042* (2013.01)

(58) Field of Classification Search
CPC ..... H01R 43/042
See application file for complete search history.

(56) References Cited

U.S. PATENT DOCUMENTS 3,393,438 A * 7/1968 Marley ..... H01R 43/0421 29/566.4
8,161,789 B2 * 4/2012 Battenfeld ..... H01R 43/042 72/409.13
2009/0249855 A1 10/2009 Battenfeld et al.
2019/0052041 A1 2/2019 Kossak

FOREIGN PATENT DOCUMENTS

DE 20100031 * 6/2002
DE 10140270 B4 * 9/2004
EP 2562891 A1 * 2/2013
WO 2020/187356 A1 * 9/2020

OTHER PUBLICATIONS

International Search Report, International App. No. PCT/IB2021/061928 International Filing Date Dec. 17, 2021.

* cited by examiner

*Primary Examiner* — Minh N Trinh

(57) ABSTRACT

A terminal holding device, a crimping hand tool and a method of positioning a terminal in a die assembly of a crimping hand tool. The terminal holding device includes a base having at least one slot provided therein. A terminal holder is movably mounted on the base. The terminal holder has terminal receiving areas for receiving terminals therein. The terminal holder has at least one mounting projection extending therefrom. The at least one mounting projection of the terminal holder is positioned in the at least one slot of the base. The at least one slot is configured to allow the at least one mounting projection to be moved in a linear direction relative to the base and rotated in the slots, allowing the terminal holder and the terminals to be properly positioned relative to the crimping hand tool.

16 Claims, 11 Drawing Sheets

TERMINAL HOLDING DEVICE FOR CRIMP HAND TOOL

FIELD OF THE INVENTION

The present invention is directed to a crimping hand tool. In particular, the invention is directed to a terminal holding device for properly positioning a terminal in the crimp hand tool.

BACKGROUND OF THE INVENTION

Crimping hand tools are used for pressing or crimping a work piece in a tool or die located in a head of the crimping hand tools. Such crimping hand tools may be used for crimping a connector or electrical contact with an end of an electric wire, wherein an insulation might be removed from the end of the electrical wire before crimping the connector or contact upon the end.

It is known to equip crimping hand tools with a locator to facilitate positioning the work piece or terminal relative to the head of the hand tools and relative to the tool or dies. The locator is used to provide a precise position of the terminal at the start of the crimping process. The locator is particularly beneficial to position small terminals relative to the tool or dies, as manual positioning of a small terminal in tool or die is difficult or unsuitable for reaching a desired position with a desired small tolerance.

The prior art discloses many different embodiments of crimping hand tools and locators. However, the locators of the prior art do not provide the user or operator of the crimping hand tool with the proper degrees of freedom to precisely control the positioning and orientation of the terminal. For example, U.S. Pat. No. 8,161,789 discloses a locator which is rotated about a fixed point, causing the terminal to be positioned at a fixed position relative to the tool or dies when the locator and terminal are rotated to the installation position.

It would, therefore, be beneficial to provide a locator or terminal holder for use with a crimping hand tool which has sufficient degrees of freedom of movement to precisely control the positioning and orientation of the terminal in the die region of the crimping hand tool, thereby allowing the terminal to be positioned and oriented in a manner to avoid a faulty termination.

SUMMARY OF THE INVENTION

An embodiment is directed to a terminal holding device for use with a crimping hand tool. The terminal holding device includes a base having at least one slot provided therein. A terminal holder is movably mounted on the base. The terminal holder has terminal receiving areas for receiving terminals therein. The terminal holder has at least one mounting projection extending therefrom. The at least one mounting projection of the terminal holder is positioned in the at least one slot of the base. The at least one slot is configured to allow the at least one mounting projection to be moved in a linear direction relative to the base and rotated in the slots, allowing the terminal holder and the terminals to be properly positioned relative to the crimping hand tool.

An embodiment is directed to a crimping hand tool for crimping a terminal to a conductor. The crimping hand tool includes crimping dies. A terminal holding device mounting area is provided proximate the head. A terminal holding device is positioned in the terminal holding device mounting area. the terminal holding device has a base and a terminal holder. The terminal holder is movably mounted on the base. The terminal holder has terminal receiving areas for receiving terminals therein. The terminal holding device is rotatable and movable in a linear direction relative to the base and the crimping dies.

An embodiment is directed to a terminal holding device for use with a crimping hand tool. The terminal holding device includes a base with at least one slot provided therein. The base has a mounting opening which engages a mounting device of the crimping hand tool. The base has base magnets. A terminal holder is pivotably mounted on the base. The terminal holder has terminal receiving areas for receiving terminals therein. The terminal holder has at least one mounting projection extending therefrom. The terminal holder has terminal holder magnets. The at least one mounting projection of the terminal holder is positioned in the at least one slot of the base. The base magnets and the terminal holder magnets cooperate to properly position the terminal holder and the terminals relative to the crimping hand tool.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
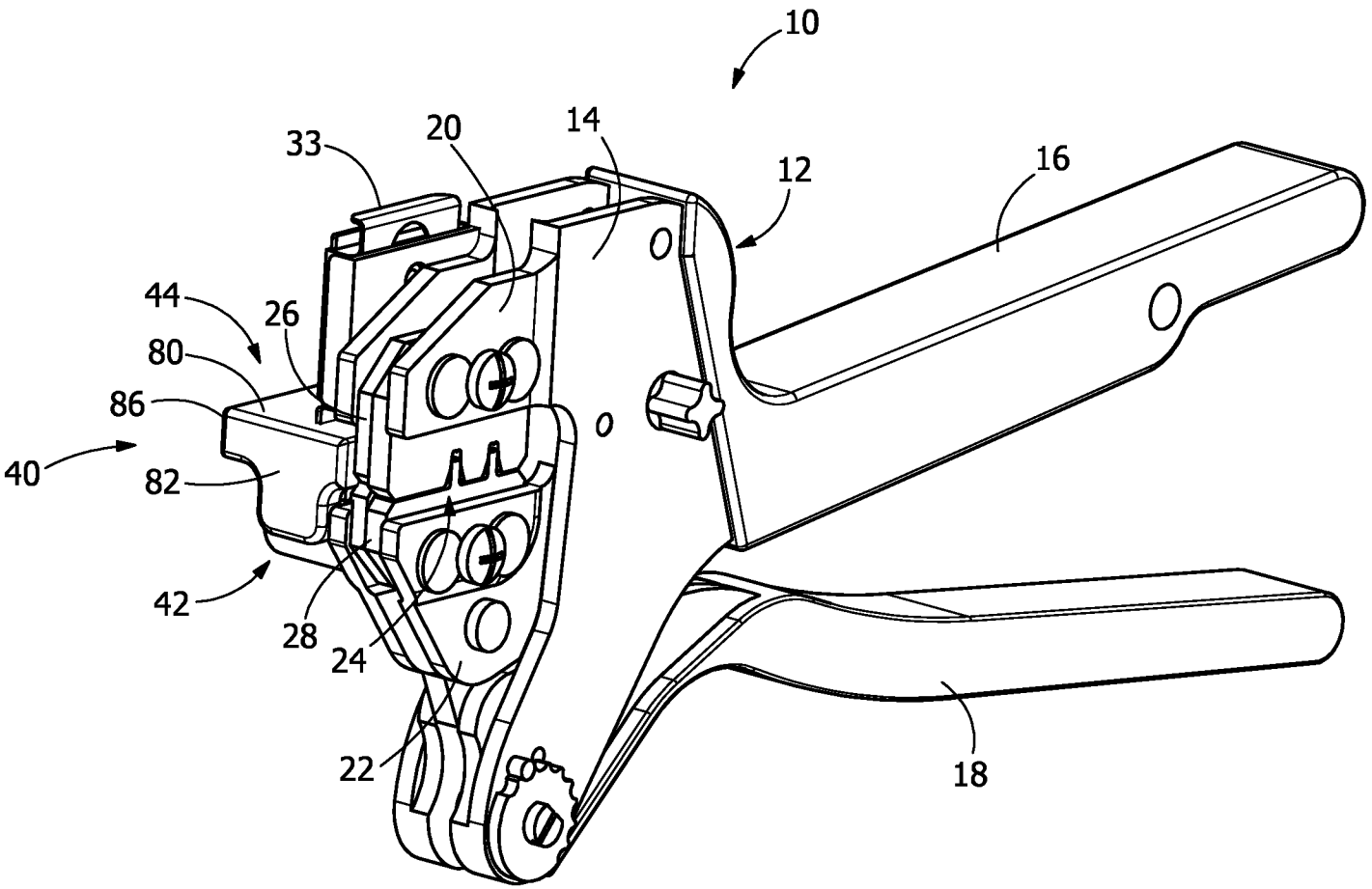
FIG. 1 is a perspective view of an illustrative crimping hand tool with a terminal holding device according to the present invention attached thereto.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
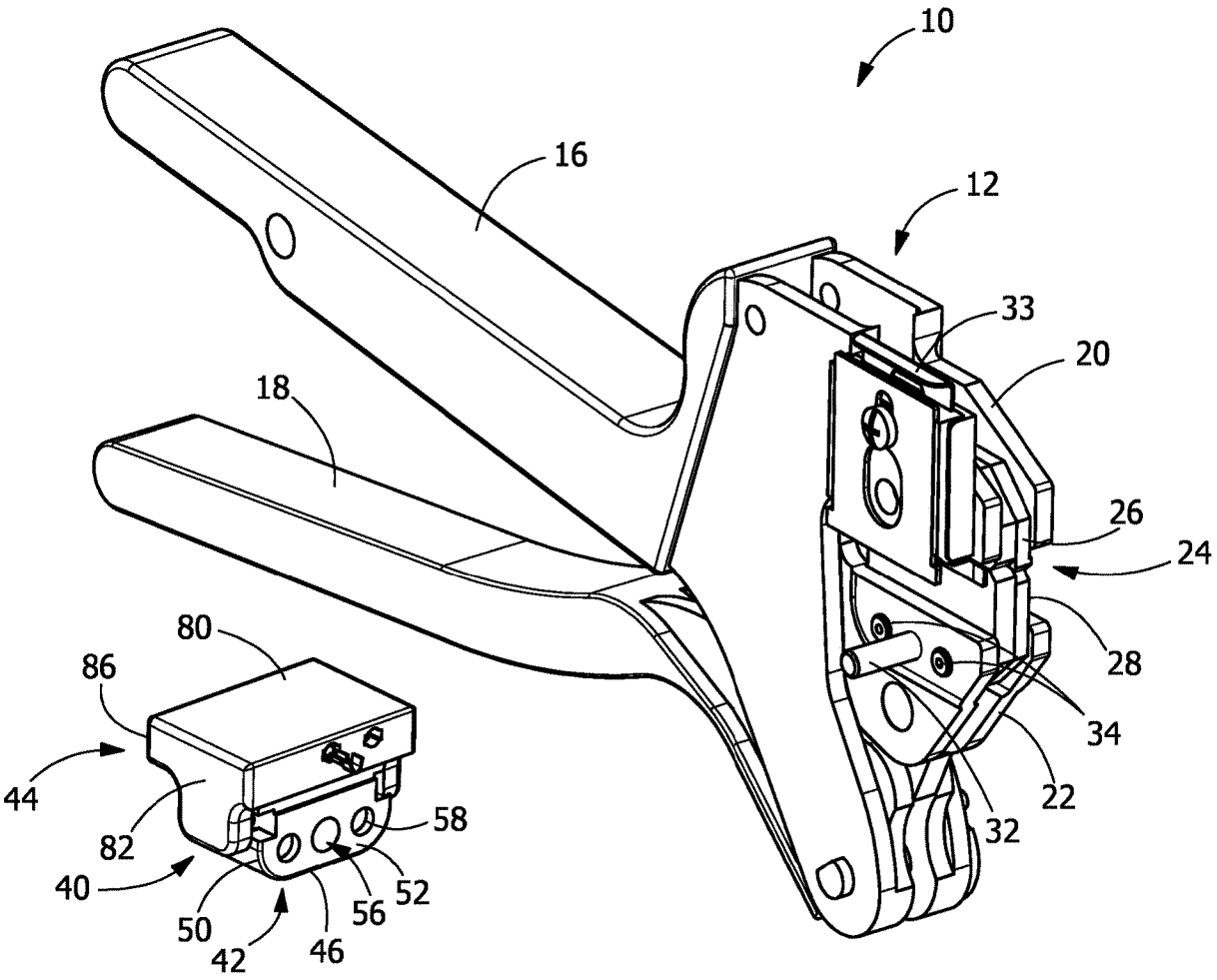
FIG. 2 is a perspective view of the crimping hand tool of FIG. 1 with a terminal holding device exploded therefrom.

As shown in FIGS. 1 and 2, a hand tool 10 for crimping terminals 36 has a frame 12 with a crimping section 14 provided thereon. A fixed handle 16 extends from the frame 12. A movable handle 18 extends from the frame 12 and is movable relative to the fixed handle 16.

Two fixed plates 20, 22 are provided on the frame 12 in the crimping section 14. A terminal receiving slot 24 is provided between the fixed plates 20, 22. Two movable plates or dies 26, 28 are linked to the frame 12 providing a degree of freedom for relative movement of the movable dies 26, 28 with respect to the frame 12. A terminal receiving slot 30 is provided between the movable dies 26, 28. In the embodiment shown, the movable dies 26, 28 are moved along a linear path relative to the fixed plates 20, 22, although other configurations and relative movements may be used. The dies 26, 28 may be crimping dies used for plastically deforming a work piece or terminal 36 throughout a crimping process. Such deformation might be used for providing a crimping connection.

A mounting projection 32 extends from the frame 12 of the tool 10. Alignment projections 34 are provided on either side of the mounting projection 32. However, other configurations of the mounting projection 32 and the alignment projections 34 may be used. A movable locator blade 33 (FIG. 9) is provided on the frame 12.

Before starting the crimping process, the terminal 36 has to be brought into a well-defined relative position to the dies 26, 28. As shown in the embodiment in FIGS. 1 through 9, a terminal holding device 40 is provided on the tool 10 to facilitate the proper location of the terminals 36 relative to the dies 26, 28.

Figure 3:
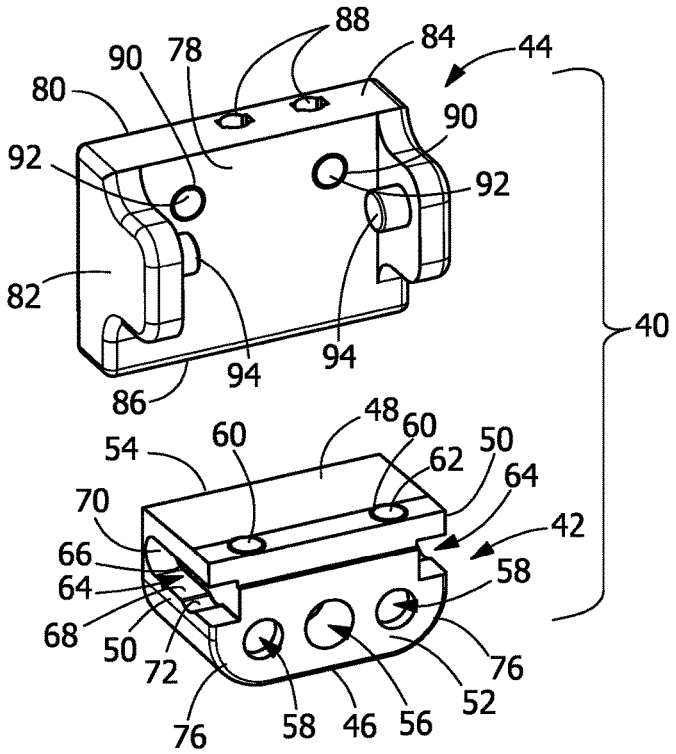
FIG. 3 is an exploded perspective view of the terminal holding device with a base separated from a terminal holder.

As shown in FIGS. 2 and 3, the terminal holding device 40 has a base 42 and a terminal holder 44 which is pivotably mounted to the base 42. Base 42 has a bottom surface 46, a top surface 48, side surfaces 50, a front surface 52 and a back surface 54.

A mounting or securing opening 56 extends through the base 42 from the back surface 54 to the front surface 52. Alignment cavities or positioning openings 58 extend from the front surface 52 toward the back surface 54. In the embodiment shown, the alignment cavities 58 are provided on either side of the mounting openings 56, although other configurations and positioning of the alignment cavities 58 may be provided.

Magnet receiving openings 60 may be provided in the top surface 48. The magnet receiving openings 60 extend from the top surface 48 toward the bottom surface 46. In the embodiment shown, two magnet receiving openings 60 are provided, although other configurations and positioning of the magnet receiving openings 60 may be provided. Magnets 62 (FIG. 4) are positioned in the magnet receiving openings 60.

The side surfaces 50 have slots 64 which extend from the front surface 52 toward the back surface 54. The slots 64 have an upper wall 66, an oppositely facing lower wall 68 and an arcuate end wall 70. The arcuate end wall 70 is positioned proximate to, but spaced from, the back surface 54. A notch or cavity 72 is provided in the lower wall 68. The cavity 72 has an arcuate configuration. A radiused portion 76 extends between each side surface 50 and the bottom surface 46.

The terminal holder 44 has a bottom surface 78, a top surface 80, side surfaces 82, a front surface 84 and a back surface 86. The front surface 84 has terminal receiving areas or terminal receiving cavities 88 which extend from the front surface 84 toward the back surface 86. In the embodiment shown, two terminal receiving cavities 88 are shown. However, other numbers of terminal receiving cavities 88 may be provided.

Magnet receiving openings 90 (FIG. 3) may be provided in the bottom surface 78. The magnet receiving openings 90 extend from the bottom surface 78 toward the top surface 80. In the embodiment shown, two magnet receiving openings 90 are provided which align with the magnet receiving openings 60 of the base 42, although other configurations and positioning of the magnet receiving openings 90 may be provided. Magnets 92 are positioned in the magnet receiving openings 90.

The side surfaces 82 extend from the top surface 80 to beyond the bottom surface 78. Mounting projections 94 extend from each respective side surface 82 is a direction toward the opposed side surface 82. In the embodiment shown, the mounting projections 94 have a cylindrical configuration, although other configurations can be used. When assembled, the mounting projections 94 of the terminal holder 44 are movably retained in the slots 64 of the base 42 and cooperate with cavities 72, as will be more fully described.

Figure 4:
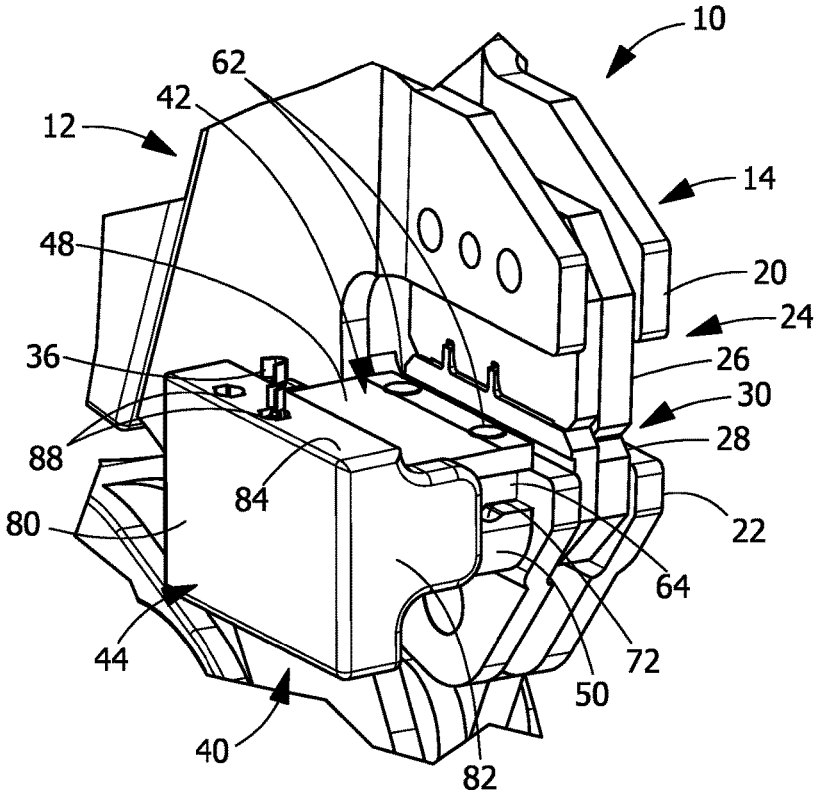
FIG. 4 is a diagrammatic view of the terminal holding device of FIG. 3 attached to the crimping hand tool, the terminal holding device is in a first position.

Referring to FIG. 4, the terminal holding device 40 is moved onto the hand tool 10. As this occurs, the mounting projection 32 of the tool in moved into the mounting opening 56 of the base 42 of the terminal holding device 40 to secure the terminal holding device 40 to the tool 10. In addition, alignment projections 34 of the tool 10 are positioned in the alignment cavities 58 of the base 42 to properly align the base 42 and the terminal holding device 40 relative to the tool 10.

With the terminal holding device 40 properly positioned on the tool 10, the terminal holder 44 is initially provided in an initial or loading position. In this position, the terminal receiving cavities 88 are spaced from the dies 26, 28 to allow the terminals 36 to be positioned in the terminal receiving cavities 88. In this initial position, the mounting projections 94 are positioned in the slots 64 proximate the arcuate end walls 70 of the slots 64.

Figure 5:
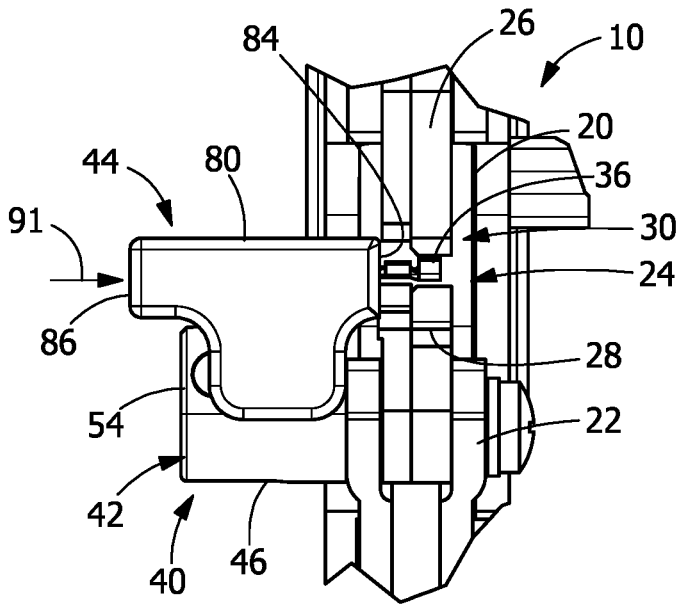
FIG. 5 is a side diagrammatic view of the terminal holding device of FIG. 3 attached to the crimping hand tool, the terminal holding device is in a second position.
Figure 6:
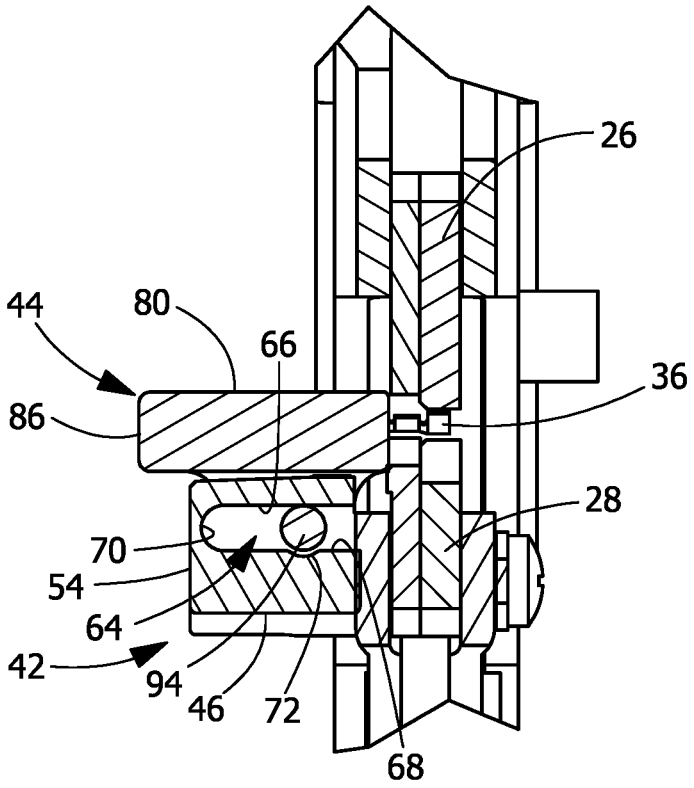
FIG. 6 is a cross-section taken along line 6-6 of FIG. 5.

With the terminals 36 positioned in the terminal receiving cavities 88, the mounting projections 94 are moved or slid in a linear direction relative to the base 42 and rotated in the slots 64, allowing the terminal holder 44 to be rotated from the position shown in FIG. 4 to the position shown in FIG. 5. As this occurs, the terminal holder 44 is moved forward, as represented by arrow 91 in FIG. 5. The forward movement causes the projections 94 to be positioned in alignment with cavities 72, as shown in FIG. 6. In this position, the terminals 36 are moved into the terminal receiving slot 30 between the dies 26, 28. The cooperation of the mounting projections 94 and the slots 64 allows the terminal holder 44 to be rotatable and movable in a linear direction relative to the base 42 and the hand tool 10.

Figure 7:
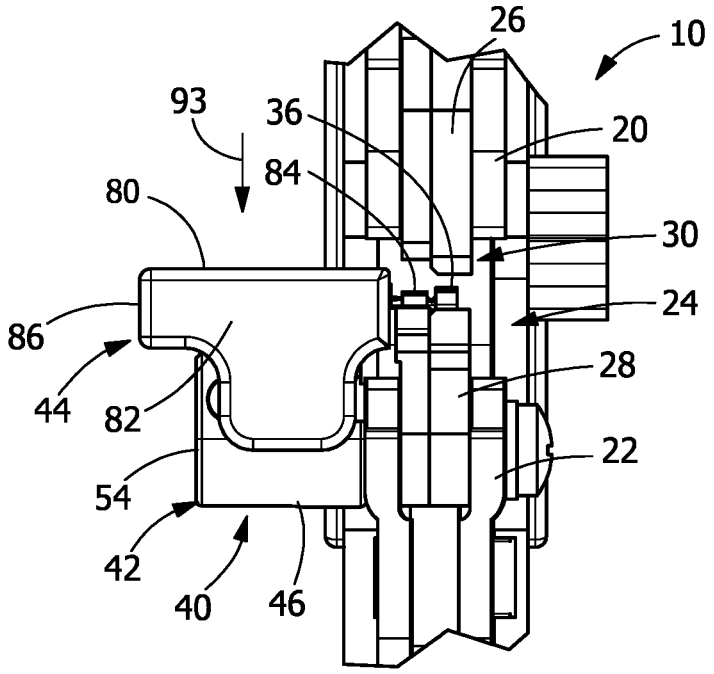
FIG. 7 is a side diagrammatic view of the terminal holding device of FIG. 3 attached to the crimping hand tool, the terminal holding device is in a third position.
Figure 8:
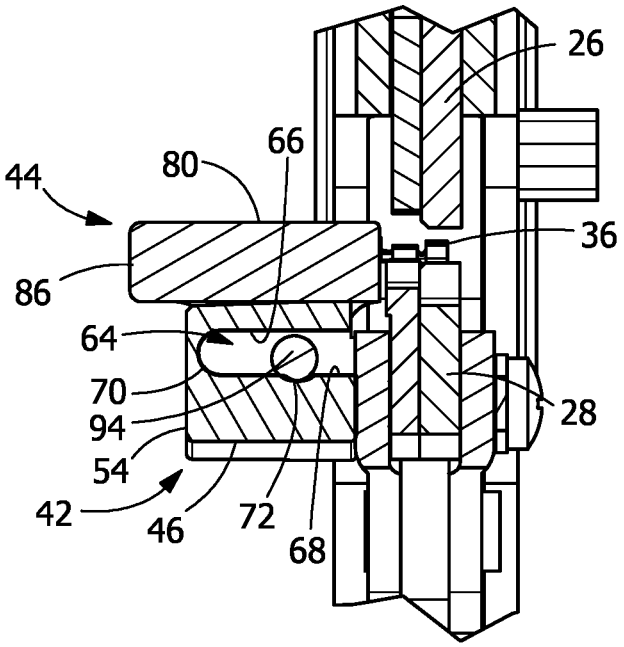
FIG. 8 is a cross section taken along line 8-8 of FIG. 7.

As shown in FIGS. 7 and 8, the terminal holder 44 is moved downward as represented by arrow 93. The downward movement is caused by the attraction of the magnets 62 with the magnets 92, which causes the terminal holder 44 to move toward the base 42. In this position, the projections 94 of the terminal holder 44 are position in the cavities 72 of the base 42 to proper position and secure the terminal holder 44 to the base 42. In this position, the terminal 36 are moved into position with respect to the dies 26, 28.

Figure 9:
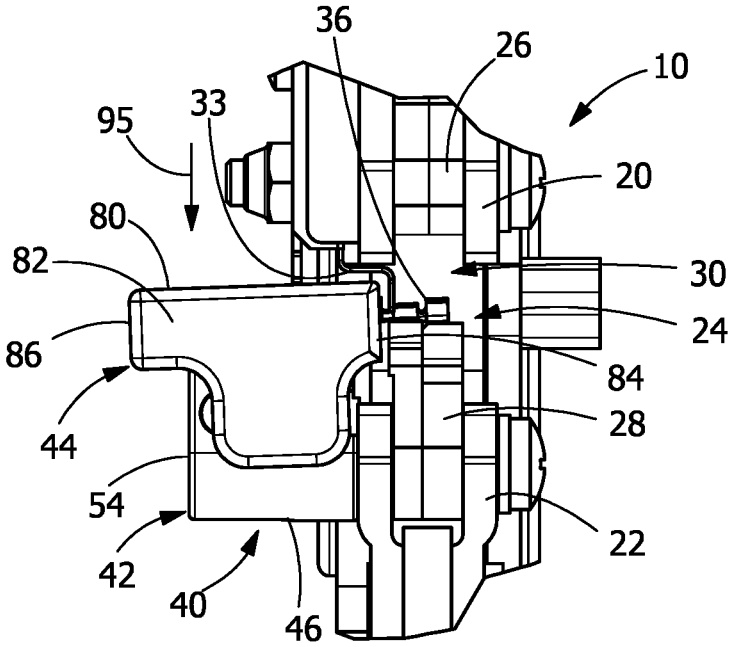
FIG. 9 is a side diagrammatic view of the terminal holding device of FIG. 3 attached to the crimping hand tool, the terminal holding device is in a fourth position.

As shown in FIG. 9, the locator blade 33 is moved downward, as represented by arrow 95, into the terminal receiving slot 30 and cooperates with the terminal 36. The locator blade 33 engages the terminals 36 to straighten the terminal 36 in the terminal receiving slot 30 as needed. With the terminal properly positioned in the terminal receiving slot 30, the dies 26, 28 are moved to properly crimp the terminals 36.

Once crimped, the terminal holder 44 of the terminal holding device 40 is moved back to the position shown in FIG. 4. Additional terminals 36 are then loaded into the terminal receiving cavities 88 and the process is repeated.

Figure 10:
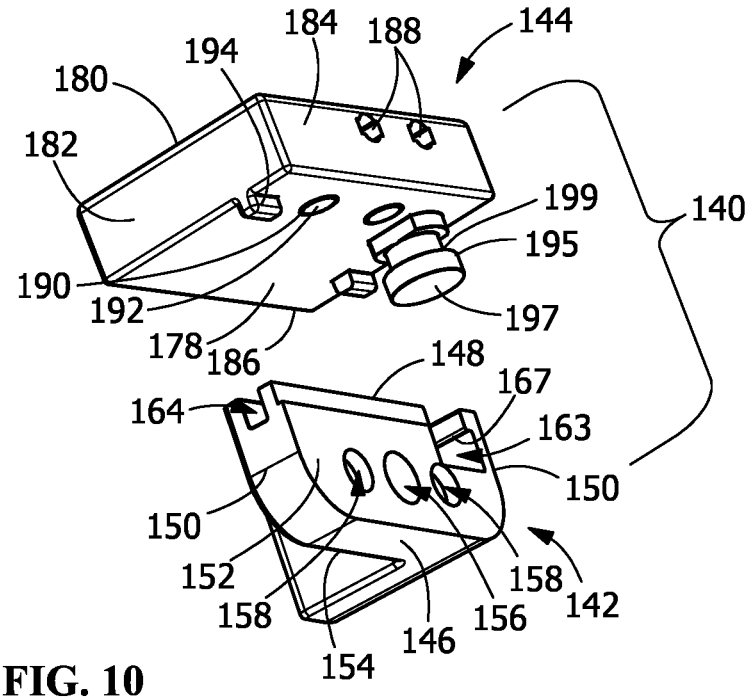
FIG. 10 is an exploded perspective view of a first alternate terminal holding device with a base separated from a terminal holder.

FIGS. 10 through 14 illustrate a first illustrative alternate embodiment of the invention. In this embodiment, the terminal holding device 140 has a base 142 and a terminal holder 144 which is pivotably mounted to the base 142. As shown in FIG. 10, the base 142 has a bottom surface 146, a top surface 148, side surfaces 150, a front surface 152 and a back surface 154.

A mounting or securing opening 156 extends through the base 142 from the back surface 154 to the front surface 152. Alignment or positioning openings 158 extend from the front surface 152 toward the back surface 154. In the embodiment shown, the alignment cavities 158 are provided on either side of the mounting openings 156, although other configurations and positioning of the alignment cavities 158 may be provided.

Magnet receiving openings 160 may be provided in the top surface 148. The magnet receiving openings 160 extend from the top surface 148 toward the bottom surface 146. In the embodiment shown, two magnet receiving openings 160 are provided, although other configurations and positioning of the magnet receiving openings 160 may be provided. Magnets 162 (FIG. 11) are positioned in the magnet receiving openings 160.

The top surface 148 has a slot 164 which extends from the top surface 148 toward the bottom surface 146. The top surface 148 also has a mounting opening 163 which extends from the top surface 148 toward the bottom surface 146. The mounting opening 163 has a shoulder 167 which is spaced from and essentially parallel to the top surface 148. The mounting opening 163 is positioned proximate the side wall 150 which is opposed to the side wall 150 which is provided proximate the slot 164

The terminal holder 144 has a bottom surface 178, a top surface 180, side surfaces 182, a front surface 184 and a back surface 186. The front surface 184 has terminal receiving areas or terminal receiving cavities 188 which extend from the front surface 184 toward the back surface 186. In the embodiment shown, two terminal receiving cavities 188 are shown. However, other numbers of terminal receiving cavities 188 may be provided.

Magnet receiving openings 190 may be provided in the bottom surface 178. The magnet receiving openings 190 extend from the bottom surface 178 toward the top surface 180. In the embodiment shown, two magnet receiving openings 190 are provided which align with the magnet receiving openings 160 of the base 142, although other configurations and positioning of the magnet receiving openings 90 may be provided. Magnets 192 are positioned in the magnet receiving openings 190.

Mounting projections 194 extend from the bottom surface 178 in a direction away from the top surface 180. In the embodiment shown, the mounting projections 194 have a rectangular configuration, although other configurations can be used. Pivot mounting member 195 extends from the bottom surface 178 in a direction away from the top surface 180. The pivot mounting member 195 has an enlarged portion 197 with a shoulder 199. The pivot mounting member 195 and the enlarged portion 197 have a generally cylindrical configuration.

Figure 11:
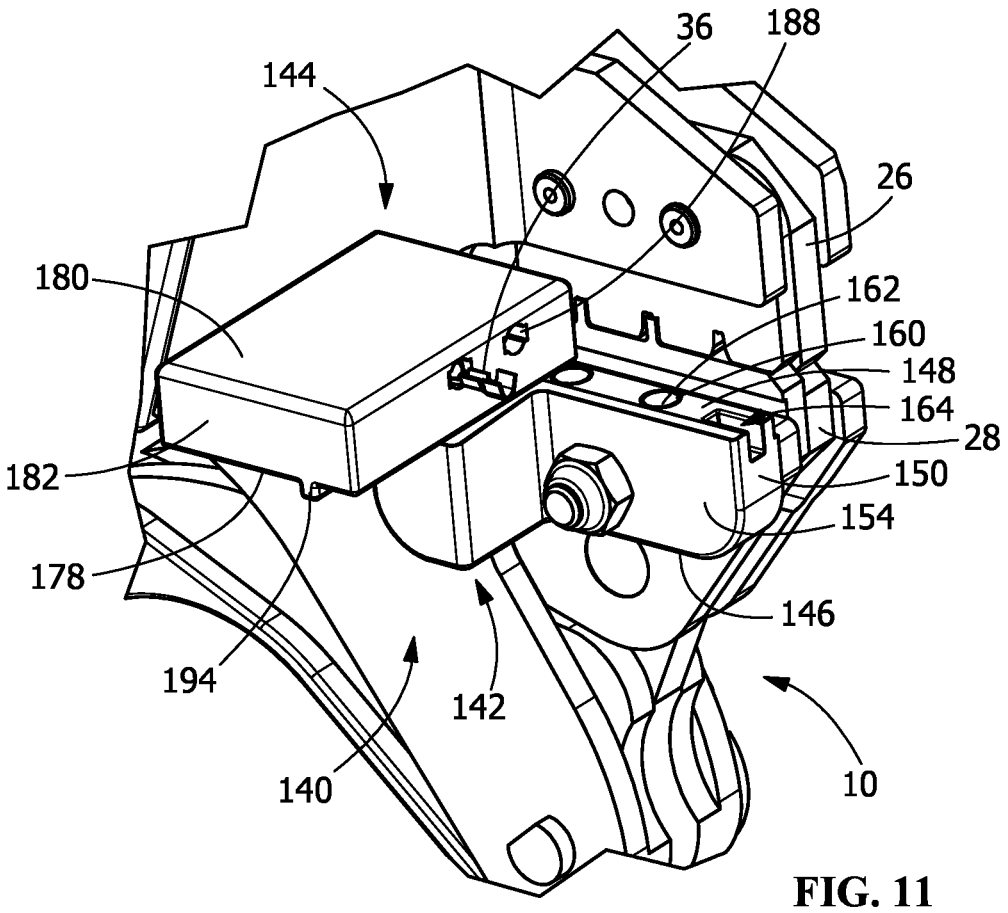
FIG. 11 is a diagrammatic view of the terminal holding device of FIG. 10 attached to the crimping hand tool, the terminal holding device is in a first position.

Referring to FIG. 11, the terminal holding device 140 is moved onto the hand tool 10. As this occurs, similar to the previous embodiment, the mounting projection and alignment projections of the tool 10 are moved into the mounting opening 156 and alignment cavities 158 of the base 142 of the terminal holding device 140 to secure the terminal holding device 140 to the tool 10.

With the terminal holding device 140 properly positioned on the tool 10, the terminal holder 144 is initially provided in an initial or loading position, as shown in FIG. 11. In this position, the terminal receiving cavities 188 are spaced from the dies 116, 128 to allow the terminals 36 to be positioned in the terminal receiving cavities 188. In this initial position, the enlarged portion 197 of the pivot mounting member 195 is positioned in the mounting opening 163 (FIG. 10). The shoulder 199 of the enlarged portion 197 cooperates with the shoulder 167 of the opening 163 to retain the enlarged portion 197 in the opening 163. In this position, the pivot mounting member 195 is pivotably or rotatably mounted in the opening 163.

Figure 12:
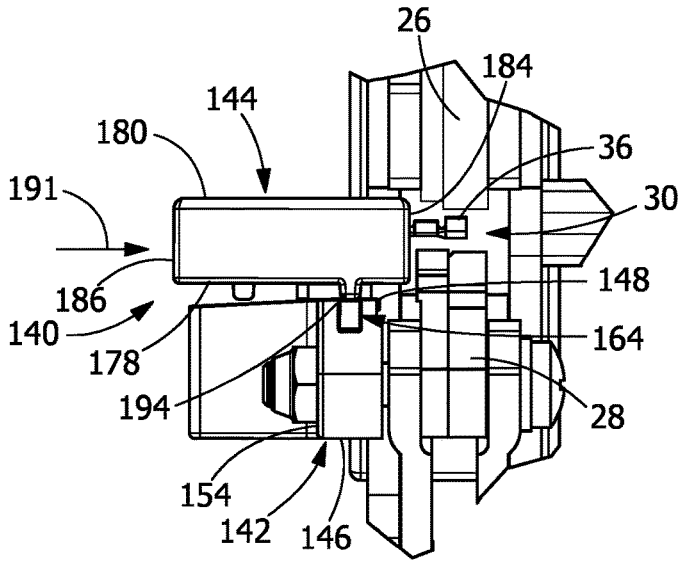
FIG. 12 is a side diagrammatic view of the terminal holding device of FIG. 8 attached to the crimping hand tool, the terminal holding device is in a second position.

With the terminals 36 positioned in the terminal receiving cavities 188, the terminal holder 144 is rotated from the position shown in FIG. 11 to the position shown in FIG. 12. As this occurs, the projection 194 is moved into alignment with slot 164. In this position, the terminals 36 are moved into the terminal receiving slot 30 between the dies 26, 28.

Figure 13:
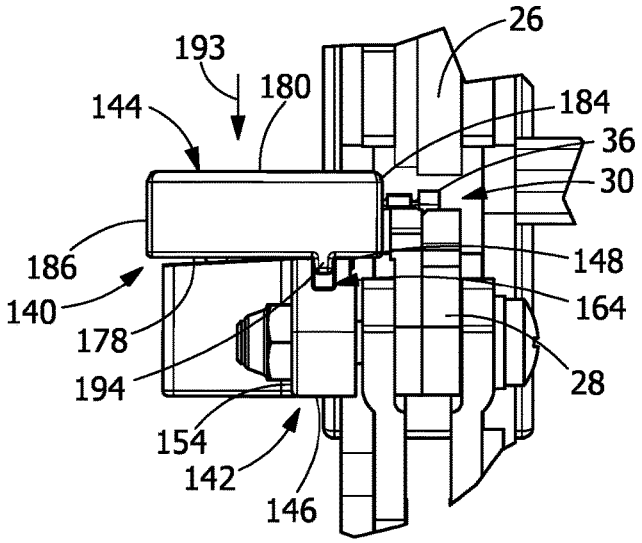
FIG. 13 is a side diagrammatic view of the terminal holding device of FIG. 10 attached to the crimping hand tool, the terminal holding device is in a third position.

As shown in FIG. 13, the terminal holder 144 is moved downward as represented by arrow 193. The downward movement is caused by the attraction of the magnets 162 with the magnets 192, which causes the terminal holder 144 to move toward the base 142. In this position, the projection 194 of the terminal holder 144 is position in the slot 164 of the base 142 to properly position and secure the terminal holder 144 to the base 142. In this position, the terminal 36 are moved into position with respect to the dies 26, 28.

Figure 14:
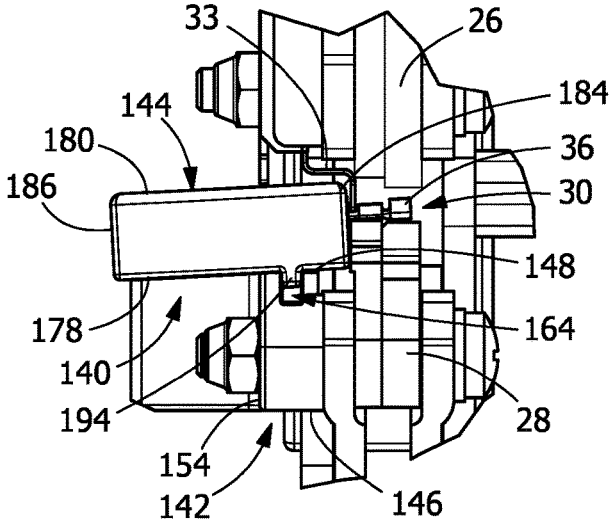
FIG. 14 is a side diagrammatic view of the terminal holding device of FIG. 10 attached to the crimping hand tool, the terminal holding device is in a fourth position.

As shown in FIG. 14, the locator blade 33 is moved into the terminal receiving slot 30 and cooperates with the terminal 36. The locator blade 33 engages the terminals 36 to straighten the terminals 36 in the terminal receiving slot 30 as needed. With the terminals properly positioned in the terminal receiving slot 30, the dies 26, 28 are moved to properly crimp the terminals 36.

Once crimped, the terminal holder 144 of the terminal holding device 140 is moved back to the position shown in FIG. 11. Additional terminals 36 are then loaded into the terminal receiving cavities 188 and the process is repeated.

Figure 15:
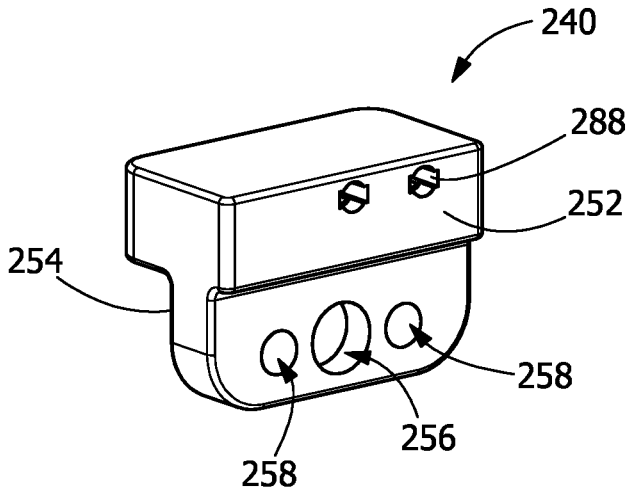
FIG. 15 is a perspective view of a second alternate terminal holding device.
Figure 16:
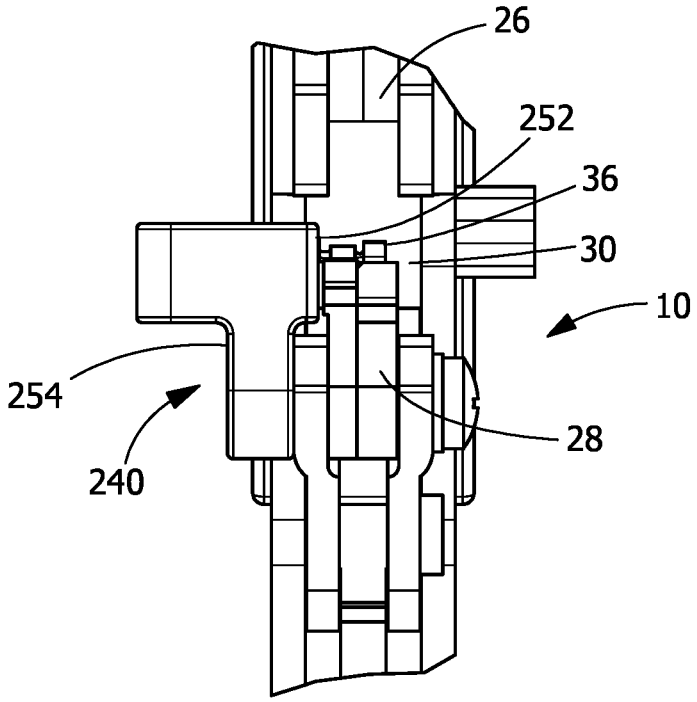
FIG. 16 is a side diagrammatic view of the terminal holding device of FIG. 15 attached to the crimping hand tool.

FIGS. 15 and 16 illustrate a second illustrative alternate embodiment of the invention. In this embodiment, the terminal holding device 240 has a mounting or securing opening 256 extends through the device 240 from the back surface 254 to the front surface 252. Alignment cavities or positioning openings 258 extend from the front surface 252 toward the back surface 254. In the embodiment shown, the alignment cavities 258 are provided on either side of the mounting openings 256, although other configurations and positioning of the alignment cavities 258 may be provided.

The front surface 252 has terminal receiving areas or terminal receiving cavities 288 which extend from the front surface 252 toward the back surface 254. In the embodiment shown, two terminal receiving cavities 288 are shown. However, other numbers of terminal receiving cavities 288 may be provided.

In this embodiment, the terminals 36 are positioned in the terminal receiving cavities 288 prior to the terminal holding device 240 being moved into engagement with the tool 10. With the terminals 36 are positioned in the terminal receiving cavities 288, the terminal holding device 240 is moved into engagement with the tool 10. As this occurs, the mounting projection 32 (FIG. 2) and alignment projections 34 (FIG. 2) of the tool 10 are moved into the mounting opening 256 and alignment cavities 258 of the device 240 to secure the terminal holding device 240 to the tool 10 and to properly position the terminals 36 in the terminal receiving slot 30 relative to the dies 26, 28. With the terminals 36 properly positioned in the terminal receiving slot 30, the dies 26, 28 are moved to properly crimp the terminals 36.

Figure 17:
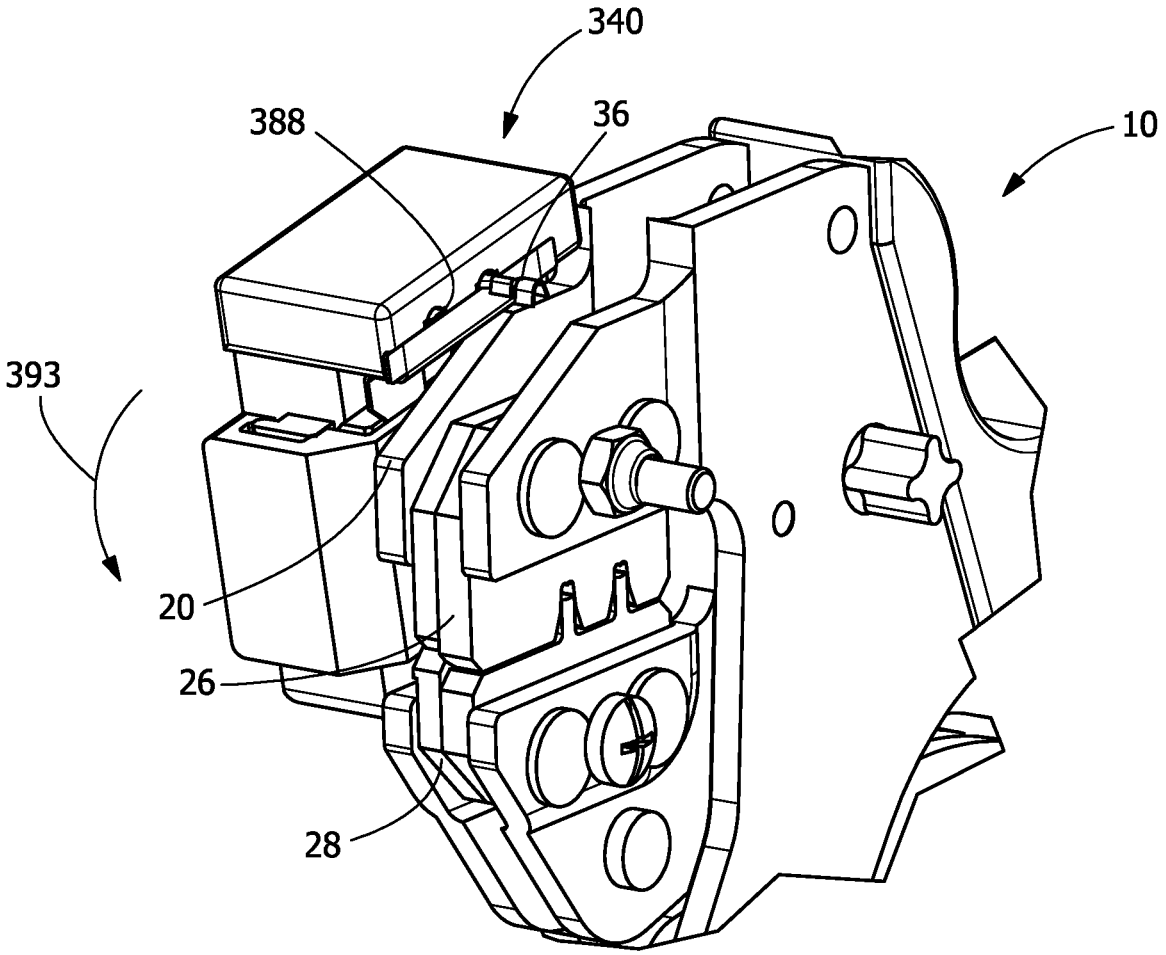
FIG. 17 is a diagrammatic view of a third alternate terminal holding device attached to the crimping hand tool, the terminal holding device is in a first position.
Figure 18:
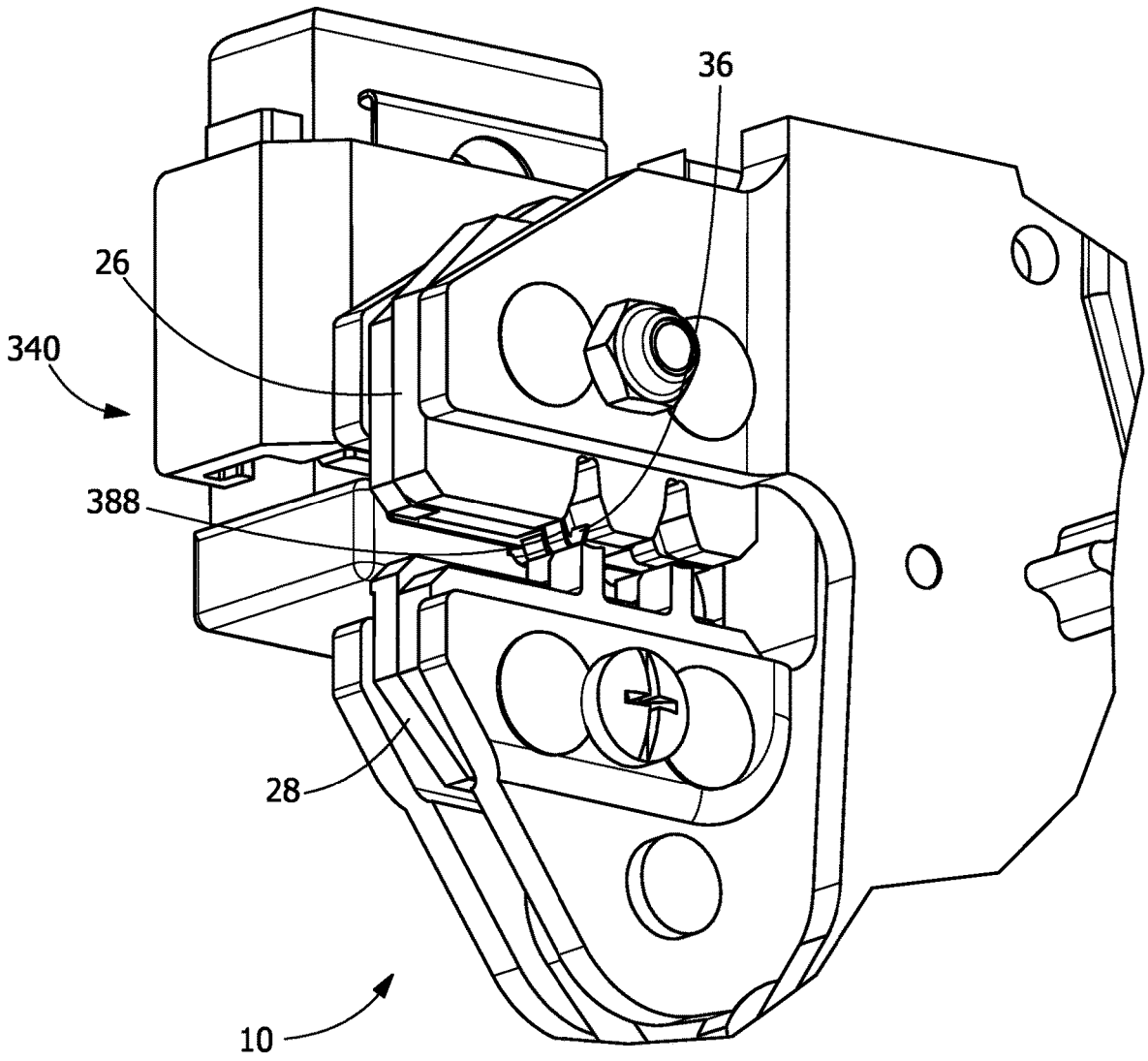
FIG. 18 is a diagrammatic view of the terminal holding device of FIG. 17 attached to the crimping hand tool, the terminal holding device is in a second position.

FIGS. 17 and 18 illustrate a third illustrative alternate embodiment of the invention. In this embodiment, the terminal holding device 340 is rotatable from a first or insertion position shown in FIG. 17 to a second or termination position shown in FIG. 18. In the first or insertion position, the terminal receiving cavities 388 are exposed above the fixed plate 20 to allow the terminals 36 to be inserted in the terminal receiving cavities 388. With the terminals 36 properly positioned in the terminal receiving cavities 388, the terminal holding device 340 is rotated, as represented by arrow 393 in FIG. 17, to the second or termination position as shown in FIG. 18. With the device rotated to the position shown in FIG. 18, the terminals 36 are moved into proper position in the terminal receiving slot 30 relative to the dies 26, 28. With the terminals 36 properly positioned in the terminal receiving slot 30, the dies 26, 28 are moved to properly crimp the terminals 36.

Once crimped, the terminals 36 are attached to wires (not shown) and removed from the terminal receiving cavities 388. The terminal holding device 340 is then moved back to the position shown in FIG. 17, allowing additional terminals 36 to be loaded into the terminal receiving cavities 388 and the process repeated.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A terminal holding device for use with a crimping hand tool, the terminal holding device comprising:

a base having at least one slot provided therein;

a terminal holder movably mounted on the base, the terminal holder having terminal receiving areas for receiving terminals therein, the terminal holder having at least one mounting projection extending therefrom;

the at least one mounting projection of the terminal holder being movably retained in the at least one slot of the base, wherein the at least one slot is configured to allow the at least one mounting projection to be moved in a linear direction relative to the base and to allow the at least one mounting projection to be rotated in the at least one slot, allowing the terminal holder and the terminals to be rotated and moved linearly relative to a terminal receiving slot provided between two dies of the crimping hand tool.

2. The terminal holding device as recited in claim 1, wherein the terminal receiving areas of the terminal holder are terminal receiving cavities which are dimensioned to receive terminals therein.

3. The terminal holding device as recited in claim 1, wherein the base has a mounting opening which extends from a crimping tool mating surface to an opposed rear surface, the opening cooperating with mounting hardware from the crimping hand tool.

4. The terminal holding device as recited in claim 1, wherein alignment cavities are provided in the crimping tool mating surface proximate the mounting opening, the alignment cavities cooperate with alignment projections of the crimping hand tool.

5. The terminal holding device as recited in claim 1, wherein the terminal holder has a base receiving surface with magnets positioned proximate thereto, the base has a terminal holder receiving surface with magnets positioned proximate thereto, wherein the magnets of the terminal holder cooperate with the magnets of the base to retain the terminal holder in a defined position relative to the base.

6. The terminal holding device as recited in claim 1, wherein the at least one slot of the base is two slots which are provided at opposite ends of the base, the two slots have an open end and a closed end, the at least one mounting projection of the terminal holder is two mounting projections which extend from opposite ends of the terminal holder and are positioned in the two slots.

7. The terminal holding device as recited in claim 6, wherein the mounting projections have a cylindrical configuration.

8. The terminal holding device as recited in claim 7, wherein the slots extend from a crimping tool mating surface to proximate an opposed rear surface.

9. The terminal holding device as recited in claim 8, wherein radiused depressions are provided in lower surfaces of the slots, the radiused depressions are dimensioned to receive portions of the slot cooperating projections.

10. The terminal holding device as recited in claim 1, wherein the at least one mounting projection of the terminal holder is one mounting projection which extends from a base receiving surface of the terminal holder.

11. The terminal holding device as recited in claim 10, wherein a slot cooperating member is provided at an end of the mounting projection, the slot cooperating projection has a diameter which is larger than the diameter of the slot cooperating member.

12. The terminal holding device as recited in claim 11, wherein the at least one slot of the base is one slot provided in a terminal holder receiving surface of the base.

13. The terminal holding device as recited in claim 12, wherein the slot extends from a crimping tool mating surface to proximate an opposed rear surface.

14. A crimping hand tool for crimping a terminal to a conductor, the crimping hand tool comprising:

crimping dies;

a terminal holding device mounting area provided proximate the head;

a terminal holding device positioned in the terminal holding device mounting area, the terminal holding device having a base and a terminal holder, the terminal holder movably mounted on the base, the terminal holder having terminal receiving areas for receiving terminals therein;

the base has at least one slot provided therein, the terminal holder has at least one mounting projection extending therefrom; the at least one mounting projection of the terminal holder is positioned in the at least one slot of the base, wherein the at least one slot is configured to allow the at least one mounting projection to move in different directions, allowing the terminal holder to be rotatable relative to the base and the head and the terminal holding device to be movable in a linear direction relative to the base and the head.

15. The crimping hand tool as recited in claim 14, wherein the base has a mounting opening which extends from a crimping tool mating surface of the base to an opposed rear surface, the opening cooperates with mounting hardware from the terminal holding device mounting area of the crimping hand tool.

16. The crimping hand tool as recited in claim 15, wherein alignment cavities are provided in the crimping tool mating surface of the base proximate the mounting opening, the alignment cavities cooperate with alignment projections of the terminal holding device mounting area of the crimping hand tool.

* * * * *